US008851307B2

(12) United States Patent
Lefevre et al.

(10) Patent No.: US 8,851,307 B2
(45) Date of Patent: Oct. 7, 2014

(54) FRAME FOR PANEL AND METHOD FOR ATTACHING A FRAME TO A PANEL

(75) Inventors: Pascal Lefevre, Viry Noureuil (FR); Gerard Huchet, Autreches (FR); Francois Vardon, Queretaro (MX); Beatrice Mottelet, Compiegne (FR)

(73) Assignee: Saint-Gobain Glass France, Courbevoie (FR)

( * ) Notice: Subject to any disclaimer, the term of this patent is extended or adjusted under 35 U.S.C. 154(b) by 174 days.

(21) Appl. No.: 13/017,425

(22) Filed: Jan. 31, 2011

(65) Prior Publication Data

US 2011/0186248 A1 Aug. 4, 2011

Related U.S. Application Data

(60) Provisional application No. 61/303,720, filed on Feb. 12, 2010.

(30) Foreign Application Priority Data

Jan. 29, 2010 (FR) ..... 10 50621

(51) Int. Cl.

| | |
|---|---|
| ***A47B 96/00*** | (2006.01) |
| ***F25D 25/02*** | (2006.01) |
| ***A47B 96/06*** | (2006.01) |

(52) U.S. Cl.

CPC ..... *F25D 25/02* (2013.01); *F25D 2325/022* (2013.01); *A47B 96/062* (2013.01)

USPC ..... 211/153; 312/408; 108/108

(58) Field of Classification Search

USPC ..... 211/90.01, 90.02, 126.15, 151, 153; 312/351, 404, 408; 108/106–110; 40/790, 791, 792

See application file for complete search history.

(56) References Cited

U.S. PATENT DOCUMENTS

| | | | | |
|---|---|---|---|---|
| 1,411,908 | A * | 4/1922 | Cacici | 38/102.91 |
| 2,568,148 | A * | 9/1951 | Goldsmith | 211/153 |
| 2,568,153 | A * | 9/1951 | Hickman | 211/153 |

(Continued)

FOREIGN PATENT DOCUMENTS

| | | |
|---|---|---|
| DE | 20 2008 013 470 U1 | 1/2009 |
| ES | 2 063 623 | 1/1995 |

(Continued)

OTHER PUBLICATIONS

U.S. Appl. No. 13/127,736, filed May 5, 2011, Huchet, et al.

(Continued)

*Primary Examiner* — Joshua Rodden

(74) *Attorney, Agent, or Firm* — Oblon, Spivak, McClelland, Maier & Neustadt, L.L.P.

(57) ABSTRACT

A frame for attachment to the periphery of a panel having a main portion, a surrounding wall designed to surround an edge of the panel, and attachment means for attaching the frame relative to the panel having at least one locking element, the locking element being connected to the main portion by a hinge and being movable relative to the main portion between an open position, in which the panel is capable of being inserted into the surrounding wall without interaction with the locking element, and a closed position, in which, when the surrounding wall surrounds the edge of the panel, the locking element is facing a main face of the panel.

14 Claims, 5 Drawing Sheets

(56) References Cited

U.S. PATENT DOCUMENTS

| | | | | |
|---|---|---|---|---|
| 4,237,632 | A * | 12/1980 | Segerstad | 40/734 |
| 4,934,541 | A * | 6/1990 | Bussan et al. | 211/153 |
| 5,042,180 | A * | 8/1991 | Horiuchi | 40/791 |
| 5,099,590 | A * | 3/1992 | Yamaguchi | 40/711 |
| 5,273,354 | A * | 12/1993 | Herrmann et al. | 312/408 |
| 5,660,777 | A * | 8/1997 | Herrmann et al. | 264/154 |
| 5,677,030 | A | 10/1997 | Shanok et al. | |
| 5,815,971 | A * | 10/1998 | Rothe et al. | 40/718 |
| 6,045,101 | A * | 4/2000 | Goyette et al. | 248/235 |
| 6,601,330 | B2 * | 8/2003 | Dusink | 40/792 |
| 6,678,982 | B2 * | 1/2004 | Pitcher et al. | 40/793 |
| 6,773,651 | B1 | 8/2004 | Goyette et al. | |
| 7,306,304 | B2 * | 12/2007 | Jang | 312/408 |
| 7,950,755 | B2 * | 5/2011 | Vardon | 312/408 |
| 8,196,325 | B2 * | 6/2012 | Pitcher et al. | 40/658 |
| 8,286,561 | B2 * | 10/2012 | Driver et al. | 108/27 |
| 8,287,062 | B2 * | 10/2012 | Nash et al. | 312/408 |
| 2002/0020096 | A1 * | 2/2002 | Dusink | 40/792 |
| 2002/0149304 | A1 * | 10/2002 | Bienick | 312/408 |
| 2006/0145577 | A1 * | 7/2006 | Daley et al. | 312/408 |
| 2006/0162373 | A1 * | 7/2006 | McMillin et al. | 62/440 |
| 2006/0254481 | A1 * | 11/2006 | Lee et al. | 108/108 |
| 2009/0051257 | A1 | 2/2009 | Picken et al. | |
| 2011/0062845 | A1 * | 3/2011 | Leconte et al. | 312/408 |
| 2011/0115356 | A1 * | 5/2011 | Nash et al. | 312/408 |
| 2012/0104924 | A1 * | 5/2012 | Nash et al. | 312/408 |

FOREIGN PATENT DOCUMENTS

| | | |
|---|---|---|
| GB | 211349 | 2/1924 |
| KR | 2002-0062392 | 7/2002 |
| WO | WO 2006/044641 A2 | 4/2006 |

OTHER PUBLICATIONS

Search Report issued Oct. 18, 2010, in France Patent Application No. FR 1050621 (FA 732524) (with English translation of Category of Cited Documents).

* cited by examiner

FRAME FOR PANEL AND METHOD FOR ATTACHING A FRAME TO A PANEL

FIELD OF THE INVENTION

The present invention relates to a frame designed to be attached to the periphery of a panel, and to an assembly comprising a panel and a frame, such as a shelf, a cover, a door or a display unit, in which the frame is attached to the periphery of the panel. The invention also relates to a method for attaching a frame to the periphery of a panel.

BACKGROUND OF THE INVENTION

It is known practice to use panels made of mineral or organic glass in order to form shelves, covers, doors of refrigerated compartments, or display units, notably for grocery stores. In these applications, the glass panel is conventionally associated with a plastic frame, which makes it possible to limit the risk of injury on the sharp edges of the panel. The plastic frame may also comprise portions for aesthetic and/or functional purposes, such as portions for receiving seals or portions for mounting on a structure. In the case of a refrigerator shelf, the frame may for example form a handle for handling the shelf at its front side, and portions for mounting the shelf in the chassis of a refrigerator at its lateral and rear sides.

There are various methods for assembling a plastic frame to a glass panel. According to a method called encapsulation, the plastic of the frame is injected onto the periphery of the panel placed in a mould so that the panel is held in a pincer grip by the plastic, which surrounds it on its edge and on each of its upper and lower faces. Such a method however requires a specific installation for each design of assembly produced, which induces a high manufacturing cost.

In other known methods, the plastic frame is formed independently of the panel and the frame is assembled with the panel by bonding or clipping the frame around the panel. In particular, U.S. Pat. No. 6,679,573 describes a shelf for a refrigerator of which the glass panel and the plastic frame are assembled by clip fastening. Accordingly, the frame comprises elastically deformable tabs for retaining the panel, which deflect upon insertion of the panel into the frame, then return to their initial rest position in such a way as to retain the panel. With such a method of assembly by clip fastening, there is however a risk that the panel will separate from the frame of the shelf when a considerable load is applied to the shelf in the position of use, the tabs of the frame then being likely to deform and to release the panel.

According to yet another known method, the frame is assembled to the panel by shrinking the plastic of the frame around the panel. In the case of a shelf intended to support a load, the assembly between the frame and the panel of the shelf may be reinforced by means of locking members, which are fitted to the frame so as to protrude towards the inside of the frame facing the face of the panel which is its lower face in the position of use of the shelf. However, these additional locking members are likely to be lost or forgotten on the assembly line of the shelf. Moreover, these locking members make the management of stocks of the parts to be supplied to the assembly line more complex.

It is these drawbacks that the invention more particularly seeks to remedy by proposing a frame that is capable of being attached to the periphery of a panel in a simple and easy manner, the assembly obtained between the panel and the frame being reliable and resistant, in particular against a load applied on the panel.

BRIEF SUMMARY OF THE INVENTION

To this end, the subject of the invention is a frame intended to be attached to the periphery of a panel, this frame comprising a main portion, a surrounding wall of which is designed to surround the edge of the panel, and attachment means for attaching the frame relative to the panel, which comprise at least one locking element, wherein the locking element is connected, preferably connected integrally, to the main portion by means of a hinge and movable relative to the main portion between an open position, in which the panel is capable of being inserted into the main portion without interaction with the locking element, and a closed position, in which, when the surrounding wall surrounds the edge of the panel, the locking element is facing a main face of the panel.

In a conventional manner, the edge of a panel is defined as being the narrow face of the panel, which is oriented in the direction of thickness of the panel and which connects the two main faces of the panel. Within the meaning of the invention, the term "frame" designates a frame surrounding the whole edge of the panel, or a portion of frame surrounding only a portion of the edge of the panel.

Thanks to the invention, it is possible to obtain a robust assembly of the frame with a panel. Specifically, the retention of the panel in the frame is provided not only on the periphery of the panel, but also at one of the main faces of the panel, by means of one or more locking elements. Therefore, in the case of a shelf, each locking element retains the panel at its lower face in the position of use of the shelf, so that the assembly between the panel and the frame withstands considerable loads applied on the panel.

Moreover, the presence of one or more locking elements, incorporated into the structure of the frame and able to move about a hinge between an open position and a closed position, allows an easy attachment of the frame according to the invention to the periphery of a panel. Specifically, in their open position, the locking elements allow access to the inner volume of the frame. These articulated locking elements also make it possible to limit, or even remove, the presence of rims on the lower face of the frame for retaining the panel in the frame, which would be likely to interfere with the sides of the panel when the panel is inserted into the frame. Therefore, the insertion of the panel into the frame can be carried out without difficulty, because there is no interaction between the sides of the panel and the frame. Moreover, the panel is locked into the frame in a simple manner, by moving each locking element from the open position to the closed position about the corresponding hinge.

According to an advantageous feature of a frame according to the invention, the locking element and the hinge are connected integrally to the main portion of the frame and made of the same material as the latter, that is to say that there is a continuum of one and the same material between the main portion, the hinge and the locking element. In particular, the frame may be made of plastic, the main portion, the locking element and the hinge then being able to be injection-moulded in a single piece. Examples of appropriate plastics for the frame include notably plastics based on polyolefins, such as polypropylene or polyethylene, based on polyamide, based on polyoxymethylene, based on polycarbonate.

Advantageously, the attachment means for attaching the frame relative to the panel comprise, in addition to at least one locking element capable of facing one of the two main faces of the panel, a rim of the main portion suitable for facing the other main face of the panel when the surrounding wall surrounds the edge of the panel. The rim and the locking element thus define between them, in the closed position of the locking element, a groove for receiving a side of the panel.

According to an advantageous feature, the frame comprises immobilization means for immobilizing the locking element in the closed position. These immobilization means may comprise a clipping member of the locking element, suitable for interacting with a complementary clipping member of the main portion. When the attachment means comprise at least two locking elements each connected to the main portion by means of a hinge, the immobilization means may also comprise complementary surfaces of these two locking elements, so that the locking elements are capable of being interlocked in one another by the engagement of their complementary surfaces.

The frame may comprise at least one locking element of elongated shape connected to one side of the main portion of the frame, this locking element preferably extending substantially over the whole length of this side. As a variant or in combination with such an elongated locking element, the frame may comprise a plurality of locking elements connected to one and the same side of the main portion of the frame and distributed over the length of this side.

According to another advantageous feature, the locking element comprises a first portion and a second portion oriented transversely relative to one another, wherein the first portion is connected to the hinge while the second portion is, in the closed position of the locking element and when the surrounding wall surrounds the edge of the panel, facing the aforementioned main face of the panel. As defined here, two portions are oriented transversely relative to one another when they are oriented on two intersecting axes, including but not necessarily on two perpendicular axes.

A further subject of the present invention is an assembly, such as a shelf, a cover, a door or a display unit, comprising a panel and a frame as described above, in which the frame is attached to the periphery of the panel.

The panel of such an assembly may be formed by a monolithic, laminated or multiple glazing made of mineral glass or organic glass. Examples of organic glass include polycarbonate and polymethyl methacrylate. When the panel is formed by a monolithic glazing made of mineral glass, it is usually toughened. As a variant, the panel of such an assembly may be formed by a metal plate or by a metal grid.

Depending on the application, the panel of such an assembly may have a flat or curved section. As an example, in the case of a shelf, the panel is preferably flat. In the case of a door, a cover or a display unit, the panel may be flat and/or curved depending upon the desired aesthetic effect. An example of a curved panel is a panel at least one portion of which is in a portion of a cylinder, this type of panel being widely used for display units in food departments of stores.

In the case of a shelf, notably for a refrigerator or similar element, the locking element is, in the closed position and when the surrounding wall surrounds the edge of the panel, facing a face of the panel intended to be its lower face in the position of use of the shelf.

Finally, the subject of the present invention is a method for attaching a frame as described above to the periphery of a panel, comprising:

- placing the or each locking element in the open position;
- inserting the panel into the main portion so that the surrounding wall surrounds the edge of the panel;
- moving the or each locking element from the open position to the closed position about the hinge;
- immobilizing the or each locking element in the closed position.

According to the invention, the insertion of the panel into the main portion of the frame may correspond, when the main portion comprises no rim capable of interfering with the sides of the panel when it is installed, to a simple installation of the panel in the surrounding wall or, when the main portion comprises such a rim, to a two-stage insertion, comprising a step of introducing one side of the panel under the rim of the main portion, then a step of tilting the panel in order to install it into the surrounding wall.

Advantageously, the immobilization of the or of each locking element of the frame in the closed position takes place by clipping the locking element relative to the main portion and/or by interlocking the locking element relative to another locking element.

BRIEF DESCRIPTION OF THE SEVERAL VIEWS OF THE DRAWINGS

The features and advantages of the invention will appear in the following description of an embodiment of a frame and a shelf according to the invention, given solely by way of example and made with reference to the attached drawings in which.

DETAILED DESCRIPTION OF THE INVENTION

Figure 1:
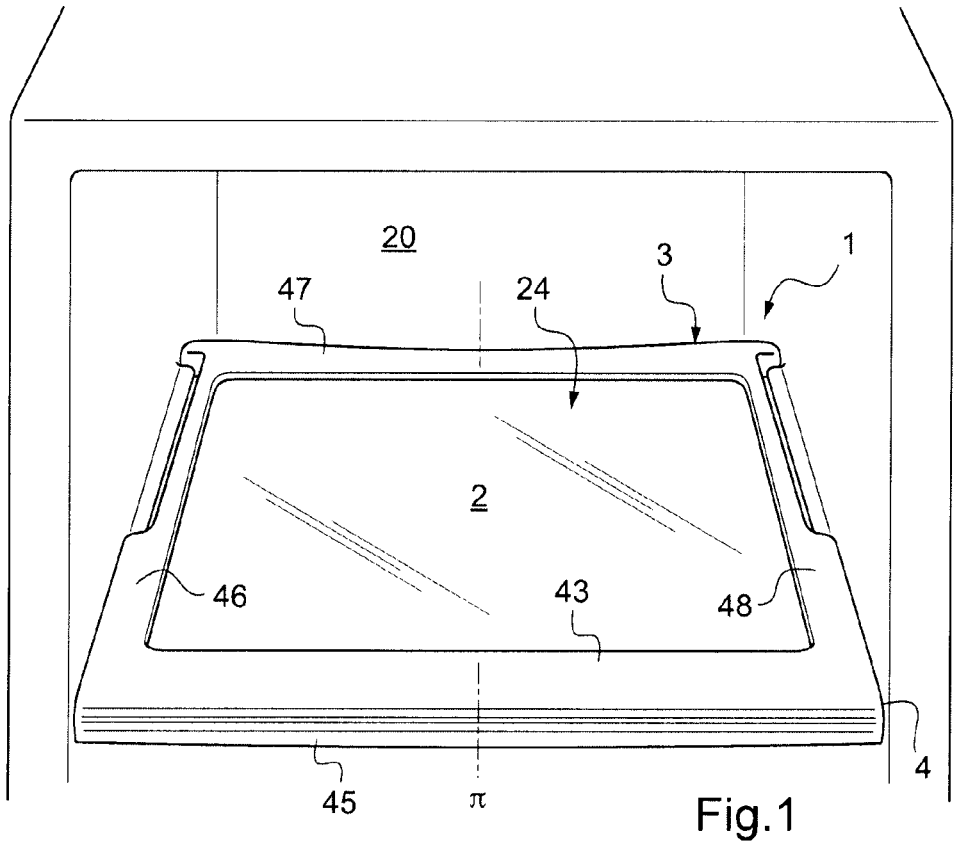
FIG. 1 is a perspective view of a refrigerator shelf in its position of use, this shelf comprising a frame according to the invention.

FIG. 1 shows a refrigerator shelf 1 which is shown in its position of use in place in a refrigerator 20. Throughout the whole of this application, "front", "rear", "right", "left", "lower", "upper" and the equivalent expressions are defined from the point of view of a user who is facing the shelf 1 placed in its position of use in a refrigerator. The shelf 1 comprises a panel 2 and a frame 3 attached to the periphery of the panel 2. As an example, in this embodiment, the panel 2 is formed by a flat monolithic glazing of rectangular shape made of toughened mineral glass, while the frame 3 is made of polypropylene-based plastic.

The frame 3 comprises a main portion 4 with four sides 45, 46, 47, 48 and three locking elements 6, 7, 8 each connected to a side 46, 47, 48 of the main portion 4 by means of a hinge-film 9. More precisely, the elements 6 and 8 are connected respectively to the left side 46 and to the right side 48 of the main portion 4, while the element 7 is connected to the rear side 47 of the main portion 4. The elements 6, 7, 8 and their hinge-films 9 are made of the same material and integrally with the main portion 4 of the frame. The frame 3 may notably be manufactured by injection-moulding, the main portion 4, the locking elements 6, 7, 8 and the hinge-films 9 being moulded in a single piece.

Figure 5:
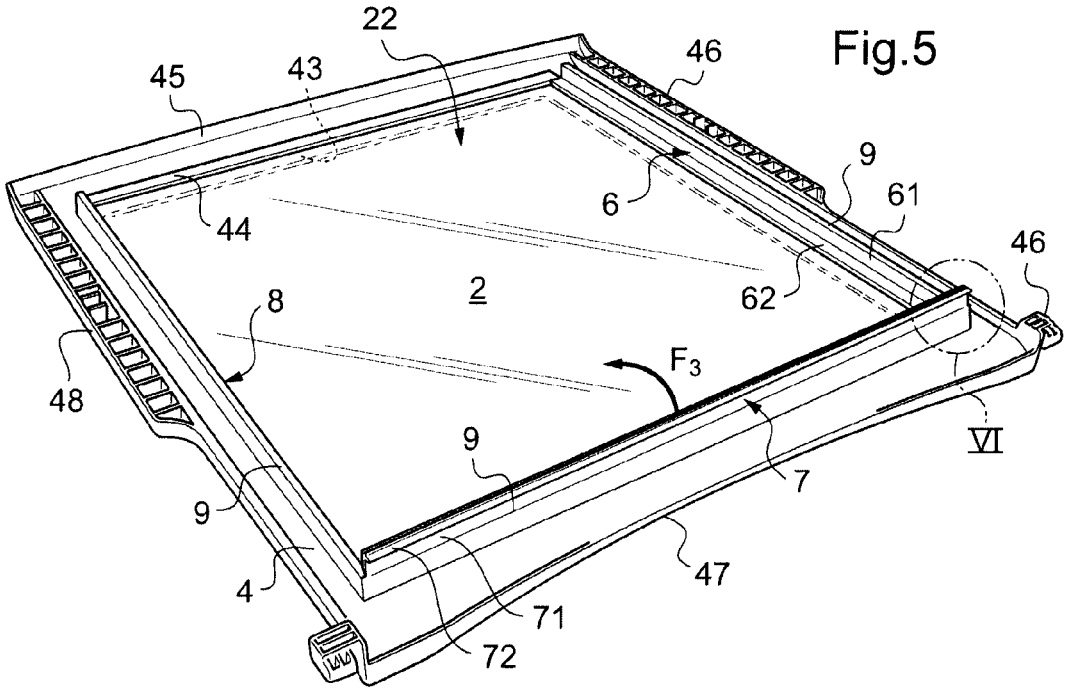
FIG. 5 is a view similar to FIG. 2, during a second step of attaching the frame to the panel.
Figure 7:
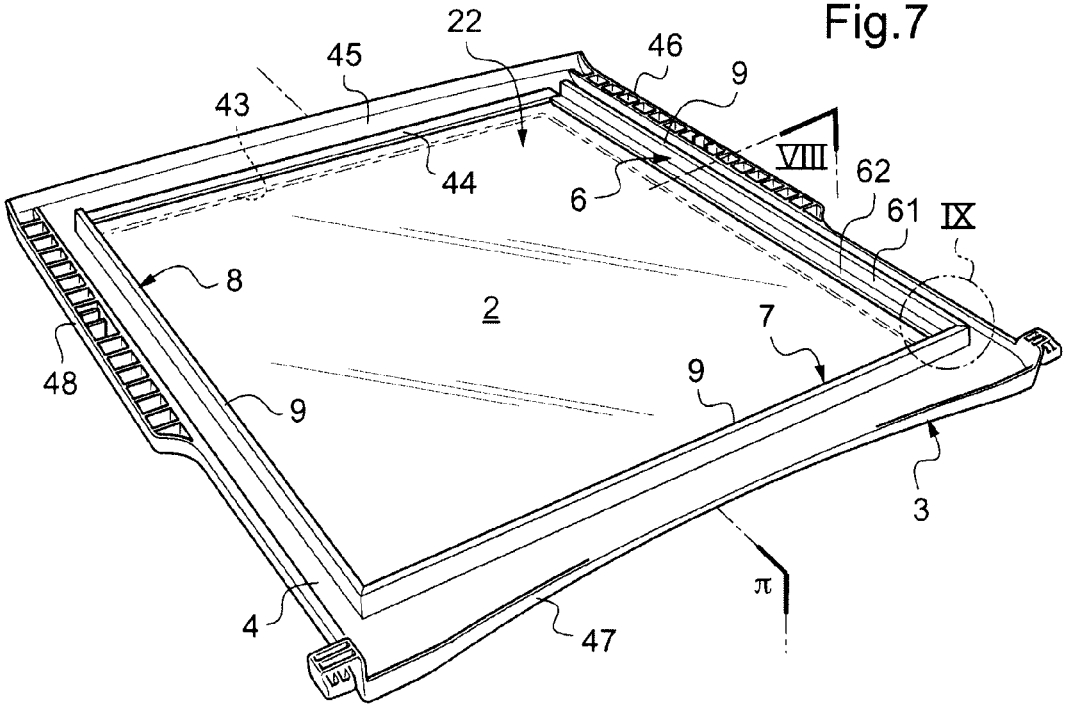
FIG. 7 is a view similar to FIG. 2, in the configuration in which the frame is attached to the panel.

The main portion 4 defines a handle for handling the shelf 1 at its front side 45 and means for mounting the shelf 1 in the chassis of the refrigerator 20 at its lateral and rear sides. Moreover, as can be seen notably in FIGS. 5 and 7, the lower face of the main portion 4 comprises, on its lateral sides 46 and 48, cavities separated by ribs. These cavities and ribs, which may be obtained by the technique called "air moulding", make it possible to economize on plastic while retaining sufficient rigidity of the main portion 4.

The main portion 4 of the frame comprises a surrounding wall 41, which is designed to surround the edge 21 of the panel 2 and which defines a rectangular contour complementing the edge 21. An upper rim 43 extends towards the inside of the main portion 4, transversely to the wall 41 and over the whole of its periphery. The upper rim 43 is designed to be applied against the upper face 24 of the panel 2 when the surrounding wall 41 surrounds the edge 21.

The surrounding wall 41 has a height, from the upper rim 43, substantially equal to the thickness of the panel 2, so that it surrounds the edge 21 of the panel over the whole of its height in the configuration in which the frame is assembled with the panel. The adjustment between the panel 2 and the main portion 4 of the frame, before locking by means of the elements 6, 7, 8, is provided with a tight clearance, allowing an effortless mounting of the frame on the panel. In other words, in the assembled but not locked configuration of the frame 3 relative to the panel 2, the distance between the surrounding wall 41 and the edge 21 of the panel is small.

The front side 45 of the main portion 4 also comprises a lower rim 44 which extends transversely to the wall 41 towards the inside of the main portion 4. The lower rim 44 is designed to face the lower face 22 of the panel when the surrounding wall 41 surrounds the edge 21. The lower rim 44 thus delimits, with the surrounding wall 41 and the upper rim 43, a groove 15 for accommodating the front side 25 of the panel 2. The lower rim 44 extends over the whole length of the front side 45, until it is attached to the two lateral sides and 48 of the main portion 4, which enhances the rigidity of the main portion 4.

On the lateral sides 46, 48 and rear side 47 of the main portion 4, the surrounding wall 41 is extended, away from the upper rim 43, by a wall 42 of lesser thickness, which is connected to the surrounding wall 41 by a shoulder 49. Each locking element 6, 7, 8 is connected integrally to the wall 42 by means of the corresponding hinge-film 9. Each element 6, 7, 8 is of elongated shape and extends substantially over the whole length of the side 46, 47, 48 to which it is attached. The length of a side of the main portion 4 of the frame is defined in this instance as the distance between the points for attaching this side to the two sides that are transversal to it.

According to a variant not shown, the frame 3 may comprise, on its front side 45, instead of the lower rim 44, a fourth locking element similar to the rear element 7 and connected to the front side 45 by means of a hinge.

Figure 6:
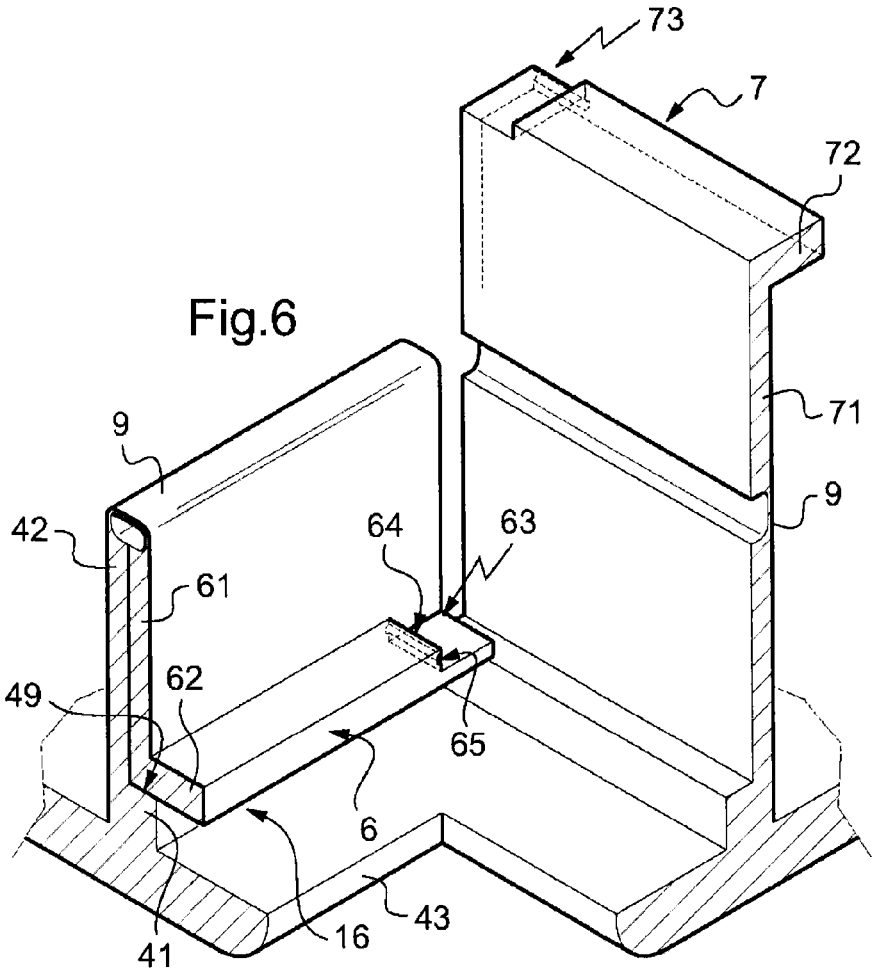
FIG. 6 is a partial view on a larger scale of the detail VI of FIG. 5.
Figure 9:
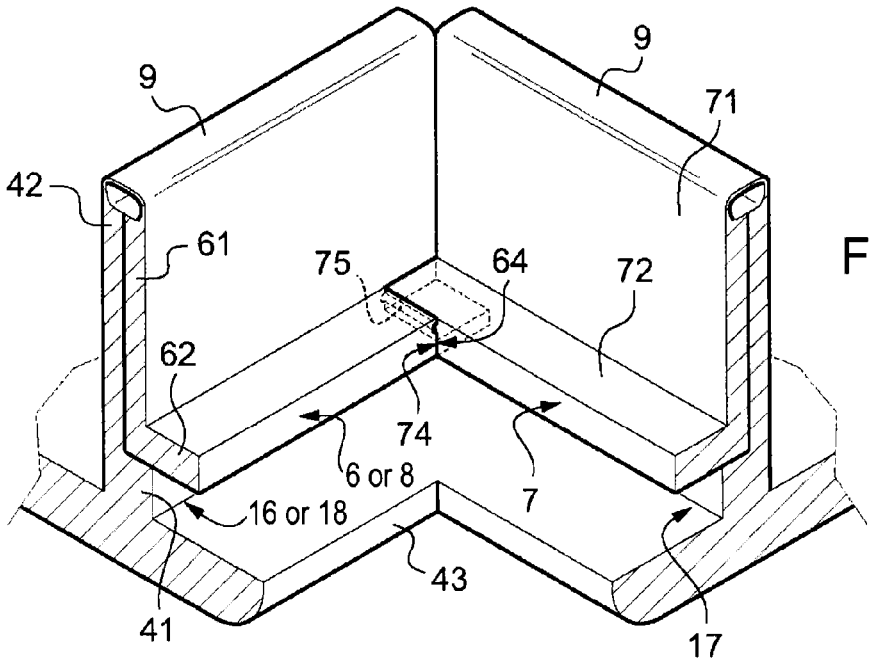
FIG. 9 is a partial view on a larger scale of the detail IX of FIG. 7.

In this embodiment, as can be clearly seen in FIGS. 6 and 9, each locking element 6, 7, 8 has an L-shaped cross section. A first portion 61, 71, 81 of the locking element, which forms the vertical bar of the L, is connected to the hinge-film 9 and capable of pressing against the wall 42 of the main portion 4. A second portion 62, 72, 82 of the locking element, which forms the horizontal bar of the L, is designed to face the lower face 22 of the panel when the surrounding wall 41 surrounds the edge 21.

As a variant, each locking element of a frame according to the invention may have a cross section that is different from an L. As an example, each locking element may have a triangular cross section, with a first side of the triangle being connected to the hinge-film 9 and a second side of the triangle being designed to face the lower face 22 when the surrounding wall 41 surrounds the edge 21.

Figure 4:
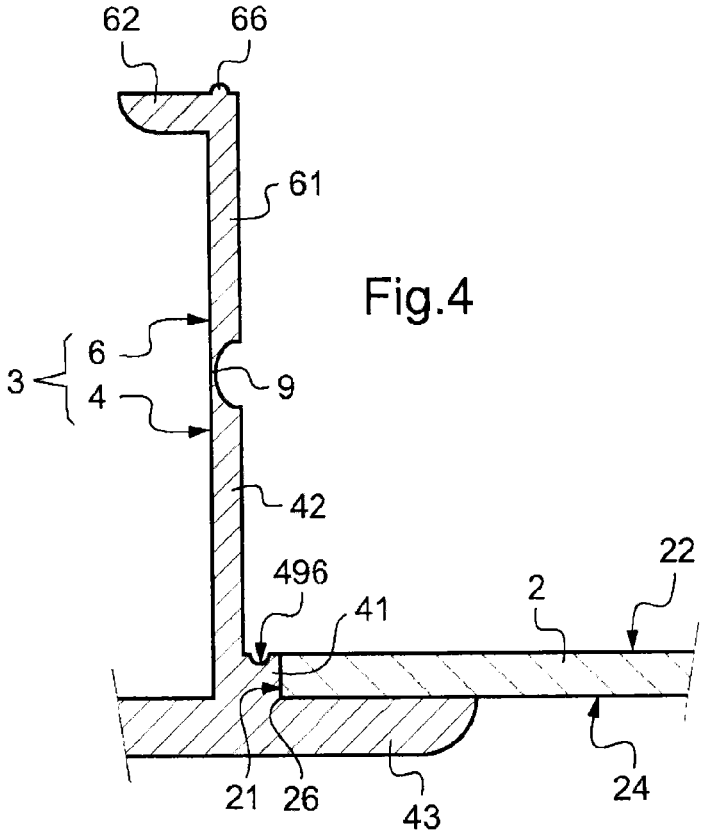
FIG. 4 is a schematic partial cross section on a larger scale on the plane IV of FIG. 2.
Figure 8:
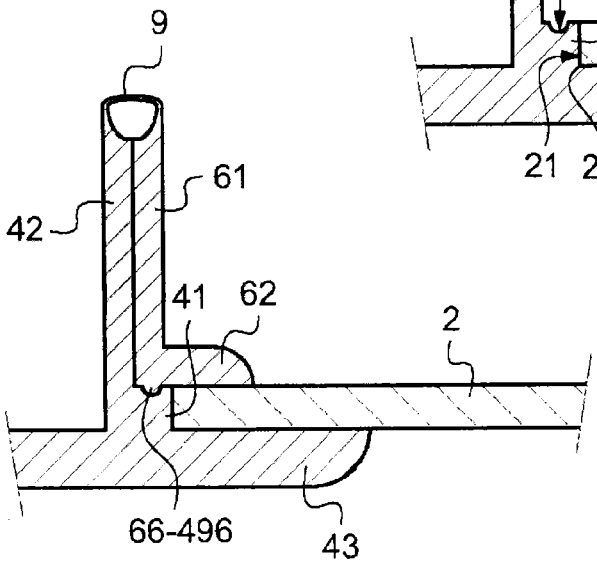
FIG. 8 is a schematic partial cross section on a larger scale on the plane VIII of FIG. 7.

Each locking element 6, 7, 8 is articulated on the wall 42 about the corresponding hinge-film 9 and is capable of pivoting between an open position, that can be seen in FIGS. 4 and 6, and a closed position, that can be seen in FIGS. 8 and 9. In the open position of a locking element 6, 7 or 8, the first portion 61, 71 or 81 of the element is placed at a distance from the wall 42 of the main portion 4, for example in the extension of the latter away from the surrounding wall 41. In the closed position of a locking element 6, 7 or 8, the first portion 61, 71 or 81 of the element is pressing against the wall 42 while the second portion 62, 72 or 82 of the element is facing the upper rim 43.

Figure 2:
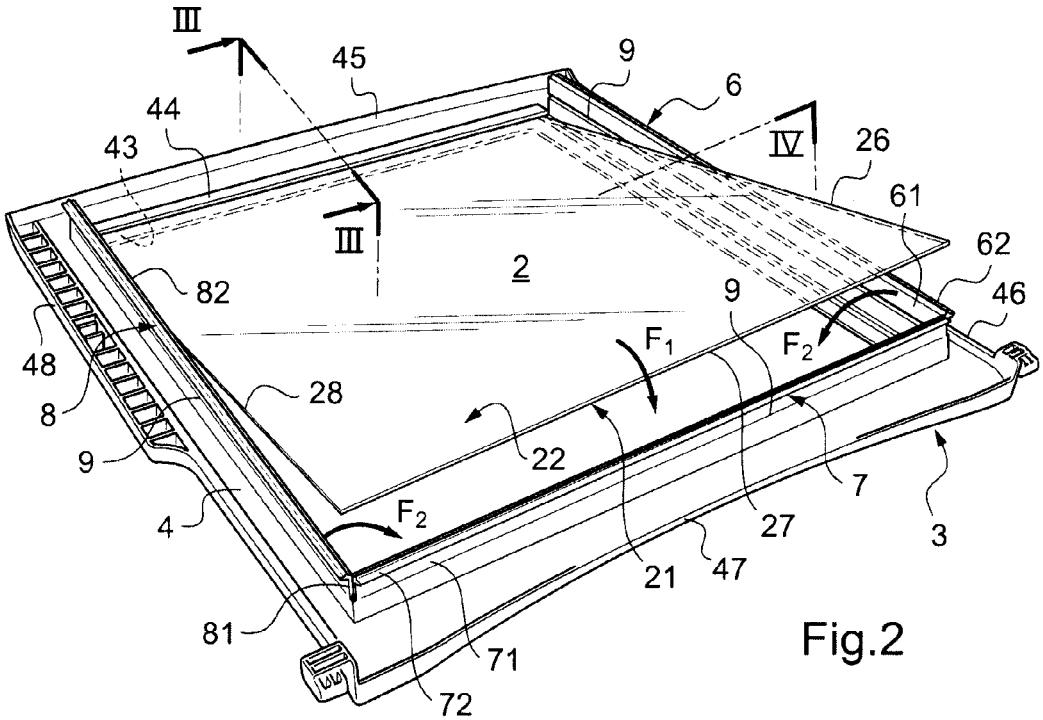
FIG. 2 is a perspective view from underneath of the shelf of FIG. 1, during a first step of attaching the frame to the panel.

When all the locking elements 6, 7 and 8 are in the open position, as shown in FIG. 2, the panel 2 is capable of being inserted into the main portion 4 without interaction with the locking elements. When a locking element 6, 7 or 8 is in the closed position, while the surrounding wall 41 surrounds the edge 21, the second portion 62, 72 or 82 of the element is pressing against the lower face 22 of the panel. Therefore, for each locking element 6, 7 or 8 in the closed position, the second portion 62, 72 or 82 delimits, with the surrounding wall 41 and the upper rim 43, a groove 16, 17 or 18 for accommodating a corresponding side 26, 27 or 28 of the panel 2.

The frame 3 comprises immobilization means for immobilizing each locking element 6, 7, 8 in its closed position. These immobilization means comprise, on the one hand, means for relative interlocking of the locking elements at the rear corners of the frame and, on the other hand, means for clipping each locking element relative to the main portion of the frame in middle zones of the lateral sides and of the rear side of the frame.

The interlocking in pairs of the locking elements at the rear corners of the frame is illustrated by FIGS. 6 and 9 for the left lateral locking element 6 and the rear locking element 7, it being understood that the relative interlocking of the right lateral locking element 8 and of the rear locking element 7 is carried out in a similar manner. In particular, the shelf 1 has a plane of symmetry $\pi$ which is the mid-plane of the shelf parallel to the lateral sides 46, 48 of the main portion 4 of the frame.

For the purpose of interlocking, the lateral locking element 6 is furnished at its rear end with a cut-out 63 made in the portion 62 of the locking element. This cut-out 63 defines a surface 64, in which a notch 65 is provided. In the same manner, the rear locking element 7 is furnished at its left end with a cut-out 73 made in the portion 72 of the locking element. This cut-out 73 defines a surface 74 matching, or complementary to, the surface 64 of the locking element 6, a protruding flange 75 being provided in the surface 74, suitable for being accommodated in the notch 65.

The locking elements 6 and 7 are thus capable of being interlocked in one another at the left rear corner of the frame, by engagement of their complementary surfaces 64 and 74. The engagement of the flange 75 in the notch 65 makes it possible to keep the locking elements 6 and 7 interlocked in one another. As a variant, keeping the locking elements interlocked in one another may be the result only of the contact friction between the complementary surfaces 64 and 74, the notch 65 and the flange 75 then being able to be omitted.

Moreover, as illustrated in FIGS. 4 and 8 for the left lateral locking element 6, each locking element 6, 7, 8 comprises, in a middle zone relative to the longitudinal direction of the locking element, a clipping rib protruding relative to the second portion 62, 72, 82 of the locking element, this rib being referenced 66 for the locking element 6. This clipping rib is provided in order to interact with a matching or complementary recess, referenced 496 for the locking element 6, arranged on the shoulder 49 of the main portion 4 of the frame.

The combination of an interlocking at the corners of the frame and a clipping in the middle zones of the sides of the main portion 4 ensures that each locking element 6, 7, 8 is immobilized over the whole of its length in the closed position.

According to a variant not shown, the locking elements may be immobilized in the closed position at the corners of the frame by clipping relative to the main portion of the frame. In particular, for the frame 3 of the previous example, the main portion 4 may comprise, at each rear corner of the frame, a portion which protrudes between the two adjacent locking elements 6, 7 or 7, 8 so that each of these two locking elements can be clipped relative to the protruding portion.

A method for attaching the frame 3 to the periphery of the panel 2 comprises steps as described below.

First of all, the frame 3 is placed on the upper face of the main portion 4, which comprises the upper rim 43, and the three locking elements 6, 7, 8 are placed in the open position, as can be seen in FIG. 2.

Figure 3:
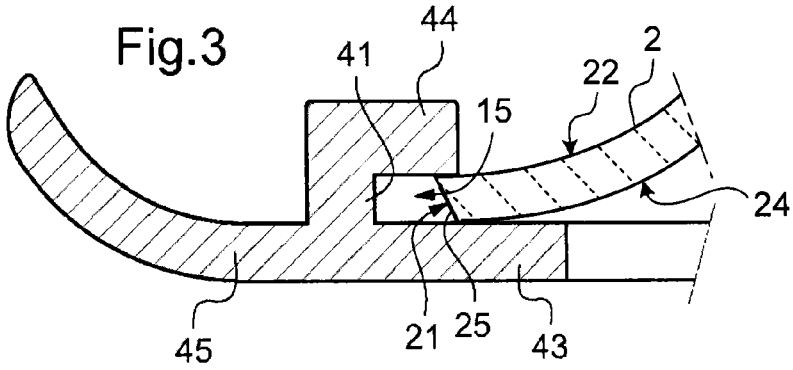
FIG. 3 is a schematic partial cross section on a larger scale on the plane III of FIG. 2.

The panel 2 is then inserted into the main portion 4 so that the surrounding wall 41 surrounds the edge 21 of the panel. For this purpose, the front side 25 of the panel 2 is introduced beneath the lower rim 44 into the groove 15 delimited in the front side 45, as shown in FIGS. 2 and 3. The panel 2 is then tilted in the direction of the arrow $F_1$ of FIG. 2, so as to place the panel 2 between the sides 46, 47, 48 of the main portion 4. Placing the panel 2 between the sides 46, 47, 48 is easy because these sides do not comprise any rims capable of interfering with the sides 26, 27, 28 of the panel 2 when the latter is installed.

As a variant, when the main portion 4 comprises no lower rim 44 capable of interfering with the sides of the panel, the panel 2 can be inserted into the main portion simply by installing the panel in the surrounding wall 41.

Once the panel 2 is inserted in the main portion 4, the assembly of the panel 2 and the frame 3 is locked. To do this, initially each of the lateral locking elements 6 and 8 is moved from the open position to the closed position by rotation about the corresponding hinge-film 9, in the direction of the arrows $F_2$ of FIG. 2. Secondly, the rear locking element 7 is moved from the open position to the closed position, by rotation about the corresponding hinge-film 9, in the direction of the arrow $F_3$ of FIG. 5. As described above, the three locking elements 6, 7, 8 are immobilized in the closed position by relative interlocking at the rear corners of the frame, on the one hand, and by clipping relative to the main portion 4 in middle zones of the sides of the main portion, on the other hand.

As emerges from the embodiment described above, the attachment of a frame according to the invention to the periphery of a panel is carried out simply and easily, by moving the locking elements between an open position allowing the panel to be inserted into the frame and a closed position for locking the frame onto the panel. By virtue of these locking elements secured to the main portion of the frame, the attachment of the frame to the panel requires no external locking part. The result of this is easier management of the stocks of parts to be supplied to the assembly line, the risk of loss of or forgetting a locking part being removed.

When the locking elements extend over the whole length of the sides of the main portion to which they are attached, as in the example above, the attachment of the frame to the panel is uniform over the whole periphery of the panel. Moreover, since the locking elements are immobilized in the closed position by interlocking and clipping, the attachment of the frame to the panel can be reversible.

The invention is not limited to the example described and shown. In particular, the locking elements of elongated shape described above can be replaced, on each side of the main portion of a frame according to the invention, by a plurality of discrete locking elements distributed over the length of the side.

Moreover, a frame according to the invention may comprise locking elements on certain of its sides only, as in the previous example in which the front side of the frame has no locking element, or else comprise at least one locking element on each of its sides.

The locking elements of a frame according to the invention may be immobilized in the closed position by any appropriate means. These immobilization means may belong to the structure of the frame, as is the case with the immobilization means by interlocking or by clipping in the previous example. As a variant, the immobilization may be obtained with the aid of means external to the structure of the frame, for example by ultrasound welding or by bonding. According to yet another variant, the immobilization of the locking elements may result from a combination of means belonging to the structure of the frame and of means external to the structure of the frame.

Figure 10:
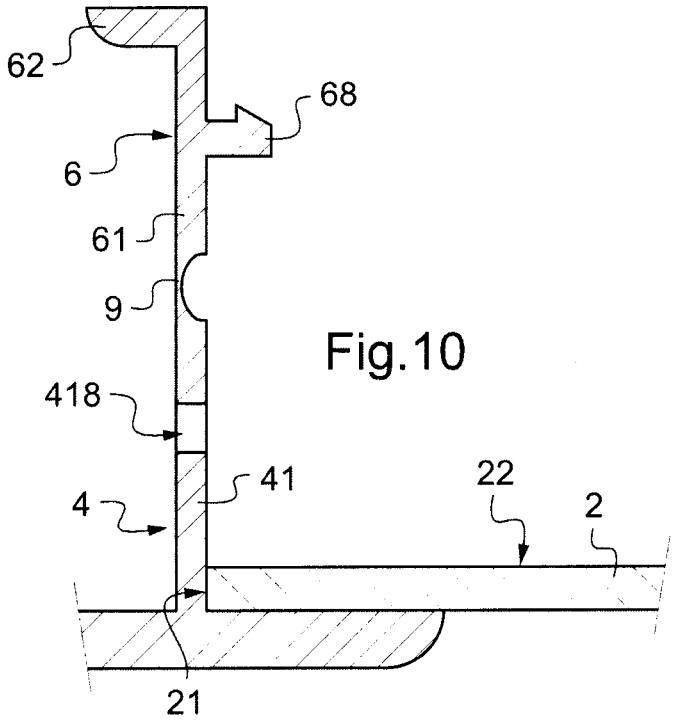
FIG. 10 is a cross section similar to FIG. 4 for a variant embodiment of the frame of FIG. 1.
Figure 11:
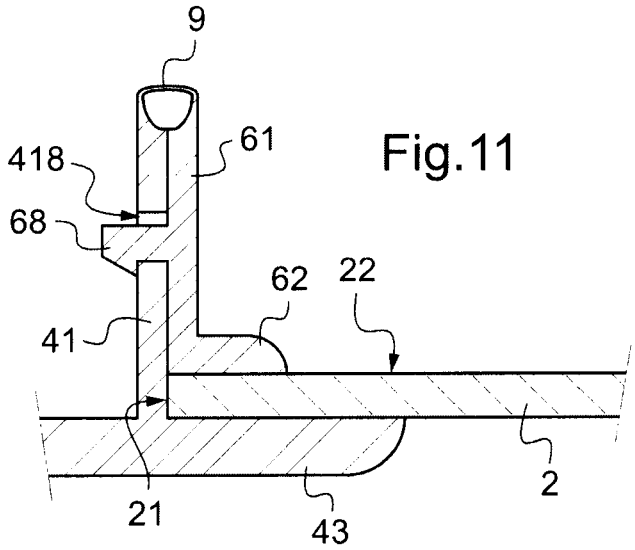
FIG. 11 is a cross section similar to FIG. 10 in the configuration in which the frame is attached to the panel.

When the frame comprises immobilization means by clipping, the clipping members may have profiles different from those of the rib 66 and the recess 496 described above, even though the latter have the advantage of being able to be obtained easily by moulding, with a relatively simple mould structure. As an example, FIGS. 10 and 11 show a variant embodiment of a frame according to the invention in which the clipping members are of different profiles.

In this variant, the surrounding wall 41 of the main portion 4 of the frame has a height greater than the thickness of the panel 2, so that it protrudes relative to the lower face 22 of the panel when the latter rests pressing against the upper rim 43. Moreover, the first portion 61 of the locking element supports a clipping pin 68, designed to interact with a complementary housing 418 arranged in the portion of the surrounding wall 41 that protrudes relative to the lower face of the panel.

Naturally, the male and female clipping members of the previous examples may be reversed, in the sense that the main portion of the frame may comprise a male clipping member, the locking element then comprising a complementary female clipping member.

Moreover, the invention has been described based on an example in which the attachment of the frame to the periphery of a panel takes place when the frame is cold, that is to say when the frame has fixed dimensions. However, when a frame according to the invention is manufactured by hot moulding and made of a plastic capable of undergoing shrinkage as it cools from the moulding temperature to the ambient temperature, the insertion of the panel into the frame and the locking of the frame onto the panel may be carried out when the frame is hot. The panel is then advantageously inserted into the main portion before the complete shrinkage of the frame, so that the surrounding wall grips the edge of the panel during the cooling of the frame. More precisely, the panel is inserted into the main portion of the frame when the latter is in a configuration in which the locking elements are in the open position and the frame is in a sufficiently hot and expanded state for there to be no interference between the surrounding wall and the sides of the panel.

In the case of an assembly using the shrinkage of the frame around the panel, it may also be advantageous to move the locking elements from the open position to the closed position while the frame is still hot. Specifically, the plastic of the frame is then more flexible, which eases the pivoting of the locking elements about their hinges. The cooling and shrinkage of the frame while the locking elements are already in the closed position may also contribute to the immobilization of the locking elements in the closed position, notably by tightening the relative interlockings of the locking elements.

Finally, as has already been evoked, a frame according to the invention may be attached to the periphery of a panel of any type, solid or in the form of a grid, with a flat or curved section, and made of any appropriate material, notably of mineral glass, of organic glass or of metal. It is also possible to form, by associating the frame with a panel, assemblies other than shelves for a refrigerator, for example covers or doors of refrigerated compartments, or display units.

The invention claimed is:

1. A frame for attachment to a periphery of a panel having at least one main face, the frame comprising:

a main portion comprising at least one surrounding wall for surrounding an edge of the panel;

means for attaching the frame relative to the panel, which comprise at least one locking element, wherein:

the locking element is connected to the main portion by a hinge;

the locking element and the main portion are in one piece; and the locking element is movable relative to the main portion between (1) an open position, in which the panel is capable of being inserted into the main portion without interaction with the locking element, and (2) a closed position, in which, when the surrounding wall surrounds the edge of the panel, a first portion of the locking element faces the main face of the panel and a second portion of the locking element abuts a part of the main portion to which it is connected by the hinge; and the hinge is placed vertically relative to the surrounding wall; and immobilization means for immobilizing the locking element in the closed position, wherein the at least one locking element of the means for attaching comprises at least two locking elements, the immobilization means comprise complementary surfaces of the locking elements, and the locking elements interlock in one another by the engagement of the complementary surfaces.

2. The frame according to claim 1, wherein the means for attaching the frame relative to the panel further comprises a rim of the main portion suitable for facing another main face of the panel when the surrounding wall surrounds the edge of the panel, the rim and each of the locking elements defining between them, in the closed position of the locking elements, a groove for receiving a side of the panel.

3. The frame according to claim 1, wherein the immobilization means further comprises a clipping member of each of the locking elements suitable for interacting with a complementary member of the main portion.

4. The frame according to claim 1, wherein each of the locking elements has an elongated shape and is connected to a corresponding one of a plurality of sides of the main portion, each of said locking elements extending substantially over the whole length of the corresponding one of the sides.

5. The frame according to claim 1, wherein said locking elements are all connected to the same side of the main portion.

6. The frame according to claim 1, wherein each of the locking elements comprises a first portion and a second portion oriented transversely relative to one another, the first portion being connected to the hinge, while the second portion is, in the closed position of the locking element and when the surrounding wall surrounds the edge of the panel, facing the main face of the panel.

7. The frame according to claim 1, wherein the frame is made of plastic, the main portion, the locking elements and the hinge are injection-molded in a single piece.

8. An assembly, comprising:

a panel; and the frame according to claim 1, wherein the frame is attached to a periphery of the panel.

9. The assembly according to claim 8, wherein the panel has a flat section.

10. The assembly according to claim 8, wherein the panel has a curved section.

11. The assembly according to claim 8, wherein the assembly is a shelf, the locking elements, in the closed position, facing a main face of the panel intended to be its lower face in the position of use of the shelf.

12. A method for attaching the frame according to claim 1 to a periphery of a panel, the method comprising:

placing the locking elements in the open position;

inserting the panel into the main portion so that the surrounding wall surrounds an edge of the panel;

moving the locking elements from the open position to the closed position about the hinges; and immobilizing the locking elements in the closed position.

13. The method according to claim 12, wherein each of the locking elements is immobilized in the closed position by clipping the locking element relative to the main portion and/or by interlocking the locking elements relative to one another.

14. A frame for a panel, comprising:

a main portion comprising at least one surrounding wall comprising a first portion, which is capable of surrounding an edge of the panel, and a second portion disposed directly above the first portion of the surrounding wall, at least one locking element comprising at least one vertical segment and at least one horizontal segment, and at least one hinge, wherein the main portion, the locking element, and the hinge are in one piece, wherein the locking element is movable through the hinge relative to the main portion between: (1) an open position, in which the panel is capable of being inserted into the main portion without interaction with the locking element, wherein the hinge is above the second portion of the surrounding wall in a vertical plane; and (2) a closed position, in which, when the first portion of surrounding wall surrounds the edge of the panel, the vertical segment of the locking element between the hinge and the horizontal segment of the locking element abuts the second portion of the surrounding wall between the hinge and the first portion of the surrounding wall, and the horizontal segment of the locking element faces a main face of the panel.

* * * * *